US009385483B2

(12) United States Patent
Wu et al.

(10) Patent No.: US 9,385,483 B2
(45) Date of Patent: Jul. 5, 2016

(54) CABLE CONNECTOR ASSEMBLY HAVING IMPROVED ANTI-EMI FUNCTION

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Zhuang-Zhi Wu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/583,743

(22) Filed: Dec. 28, 2014

(65) Prior Publication Data

US 2015/0188261 A1 Jul. 2, 2015

(30) Foreign Application Priority Data

Dec. 28, 2013 (CN) ..... 2013 1 0735456

(51) Int. Cl.

| | |
|---|---|
| ***H01R 13/6593*** | (2011.01) |
| *H01R 13/516* | (2006.01) |
| *H01R 24/60* | (2011.01) |
| *H01R 107/00* | (2006.01) |

(52) U.S. Cl.

CPC ..... *H01R 13/6593* (2013.01); *H01R 13/516* (2013.01); *H01R 24/60* (2013.01); *H01R 2107/00* (2013.01)

(58) Field of Classification Search

USPC ..... 439/607.55, 607.58, 701, 607.48, 439/607.56

See application file for complete search history.

(56) References Cited

U.S. PATENT DOCUMENTS

| | | | | |
|---|---|---|---|---|
| 5,273,459 | A * | 12/1993 | Davis | 439/607.48 |
| 5,364,291 | A * | 11/1994 | Hashiguchi | 439/607.56 |
| 7,390,220 | B1 * | 6/2008 | Wu | 439/607.06 |
| 7,736,190 | B2 * | 6/2010 | Yuan et al. | 439/660 |
| 8,109,797 | B2 * | 2/2012 | Su et al. | 439/701 |
| 8,333,616 | B2 | 12/2012 | Su et al. | |
| 8,784,136 | B2 * | 7/2014 | Siahaan et al. | 439/607.55 |
| 8,808,034 | B2 * | 8/2014 | Wu et al. | 439/660 |
| 8,961,230 | B2 * | 2/2015 | Chou | 439/607.27 |
| 9,059,543 | B2 * | 6/2015 | Wu et al. | |
| 2002/0102880 | A1 * | 8/2002 | Hoshino et al. | 439/607 |
| 2010/0233907 | A1 * | 9/2010 | Wu | 439/607.58 |

(Continued)

FOREIGN PATENT DOCUMENTS

TW M266600 6/2005

*Primary Examiner* — Alexander Gilman

(74) *Attorney, Agent, or Firm* — Wei Te Chung; Ming Chieh Chang

(57) ABSTRACT

A cable connector assembly (100) includes an electrical connector (1), a cable connecting the electrical connector electrically, an external shell (2) mounted to the connecting portion of the electrical connector and the cable. The electrical connector includes an insulative housing (12), a number of terminals (13) received in the insulative housing, and a front shell (11) mounted to the insulative housing. The insulative housing includes a base section (120) and a mating section (123) extending forwardly from the base section. The front shell (11) includes a frame portion (113) enclosing the mating section and a retaining portion (110) extending rearwardly from the frame portion and assembled to the base section. The retaining portion further defines a number of elastic portions (111) bent upwardly from the retaining portion and resisting against an inner face of the external shell.

20 Claims, 7 Drawing Sheets

(56) References Cited

U.S. PATENT DOCUMENTS

2011/0034061 A1* 2/2011 Wu ..... 439/345
2011/0034083 A1* 2/2011 Ko et al. ..... 439/607.58
2011/0281464 A1* 11/2011 Hou ..... 439/607.55
2011/0281465 A1* 11/2011 Hou ..... 439/607.55
2012/0064769 A1* 3/2012 Su et al. ..... 439/607.55
2013/0034995 A1* 2/2013 Wu et al. ..... 439/607.58
2013/0040492 A1* 2/2013 Wu ..... 439/607.55
2013/0130549 A1* 5/2013 Wu et al. ..... 439/607.01

* cited by examiner

CABLE CONNECTOR ASSEMBLY HAVING IMPROVED ANTI-EMI FUNCTION

BACKGROUND OF THE INVENTION

1. Field of the Invention

The present invention relates generally to a cable connector assembly, and more particularly to a cable connector assembly having an improved anti-EMI function.

2. Description of Related Arts

Taiwan Pat. No. M266600, issued on Jun. 1, 2005, discloses a cable connector assembly comprising an insulative housing, a plurality of terminals retained in the insulative housing, a cable electrically connected with the terminals, and a metal shell mounted to the insulative housing. The metal shell is not provided with any grounding structure.

As discussed above, a cable connector assembly having an improved anti-EMI function prevention is needed.

SUMMARY OF THE INVENTION

Accordingly, an object of the present invention is to provide a cable connector assembly with improved front and rear shells.

To achieve the above object, a cable connector assembly includes an electrical connector, a cable connecting the electrical connector electrically, an external shell mounted to the connecting portion of the electrical connector and the cable. The electrical connector includes an insulative housing, a plurality of terminals received in the insulative housing, a front shell mounted to the insulative housing. The insulative housing includes a base section and a mating section extending forwardly from the base section, the front shell includes a frame portion enclosing the mating section and a retaining portion extending rearwardly from the frame portion and assembled to the base section. The retaining portion further defines a plurality of elastic portions bent upwardly from the retaining portion and resisting against an inner face of the external shell.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
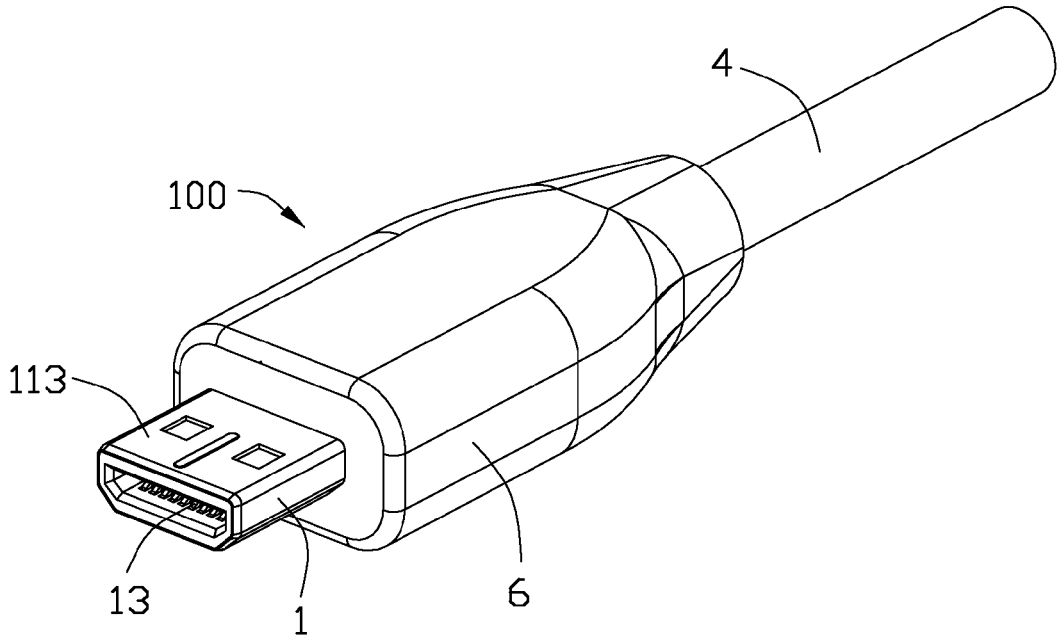
FIG. 1 is a perspective, assembled view of a cable connector assembly of the present invention.
Figure 2:
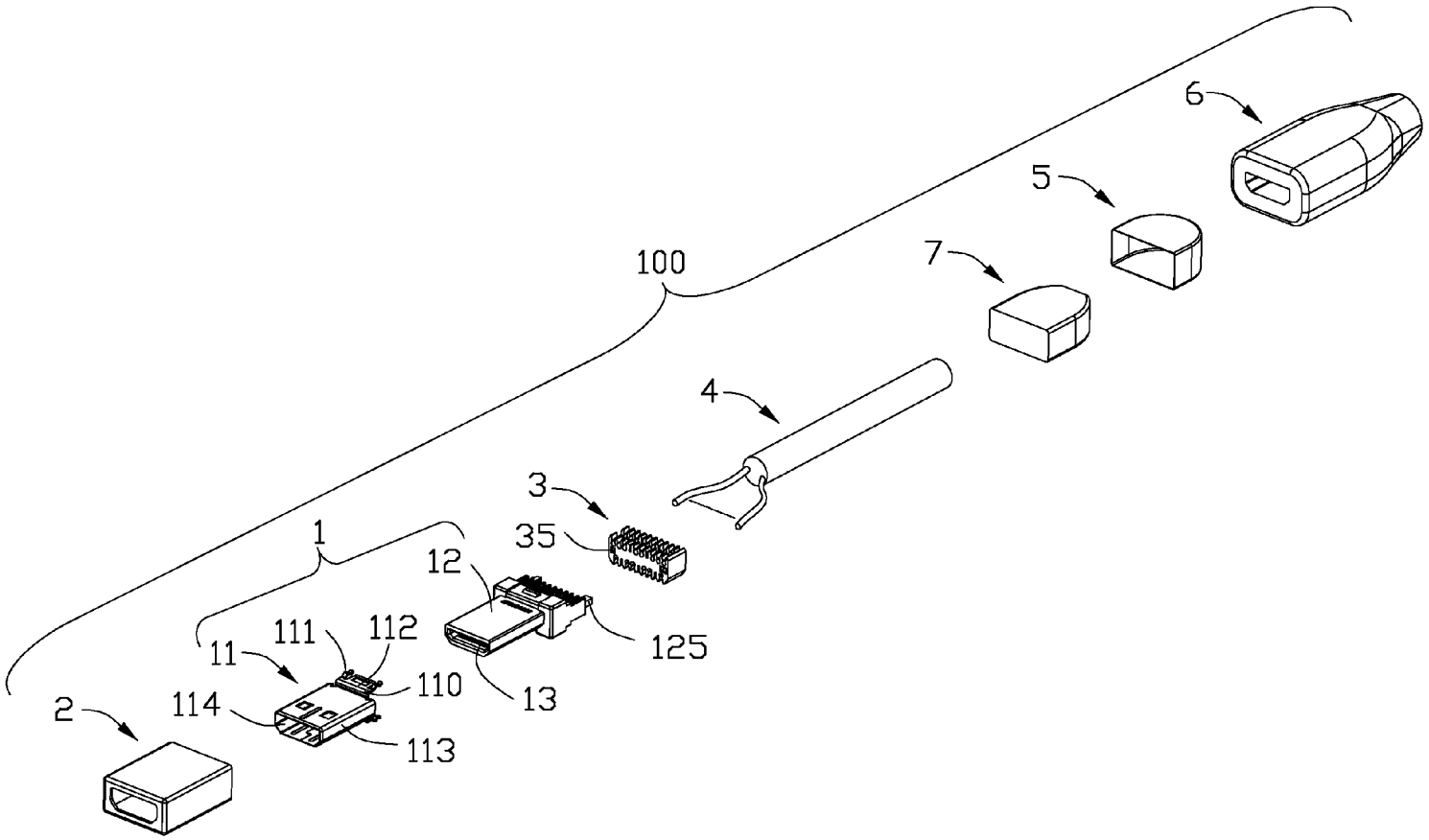
FIG. 2 is a perspective, exploded view of the cable connector assembly shown in FIG. 1.
Figure 3:
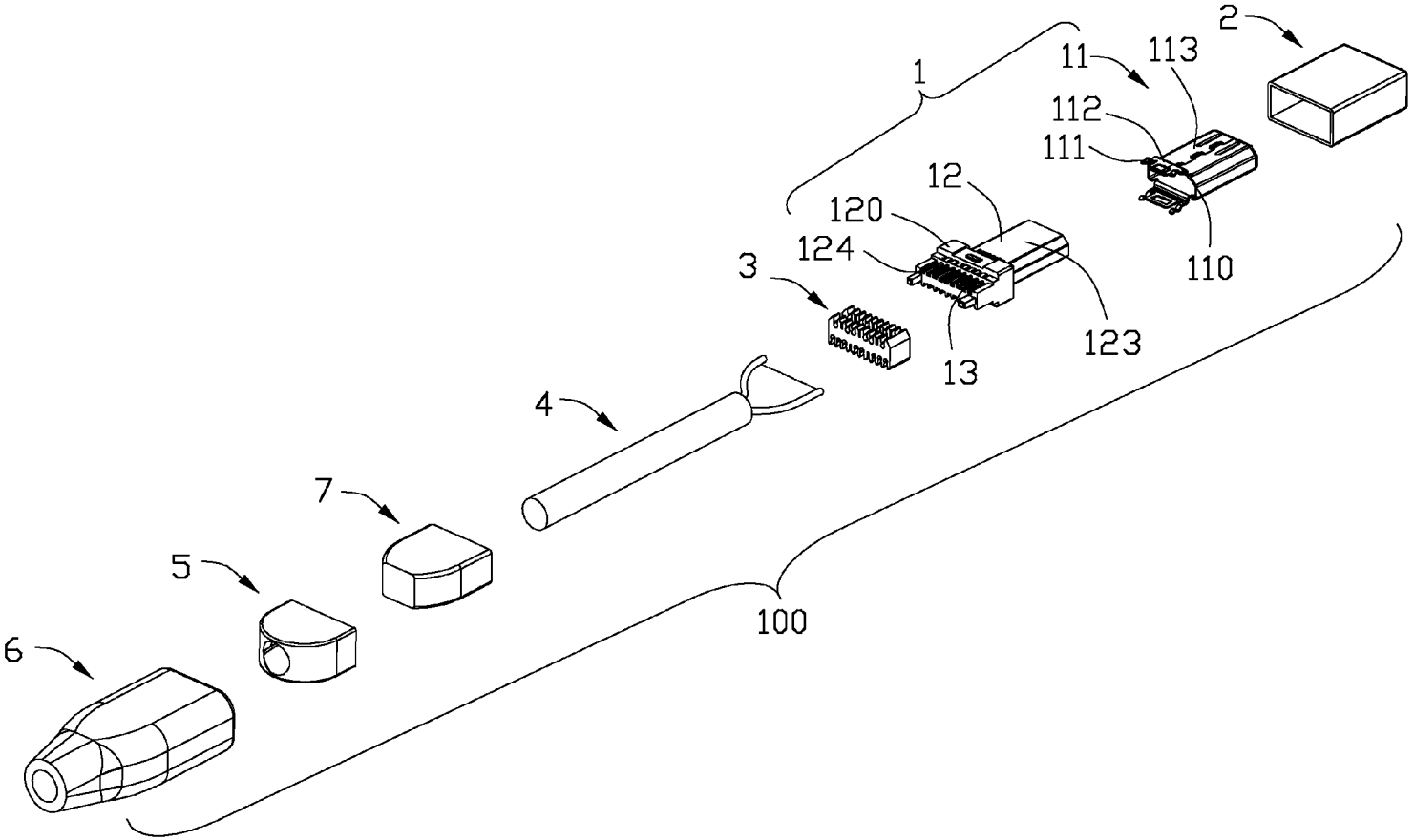
FIG. 3 is another perspective, exploded view of the cable connector assembly, taken from a different view with respect to FIG. 1.
Figure 4:
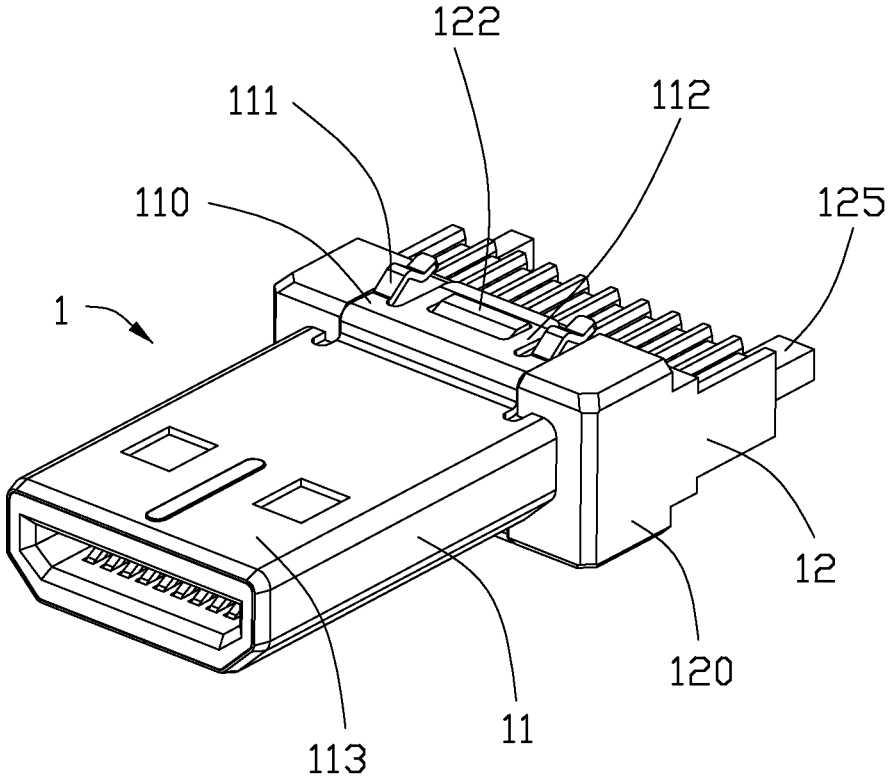
FIG. 4 is a perspective, assembled view of the electrical connector of the cable connector assembly shown in FIG. 1.
Figure 5:
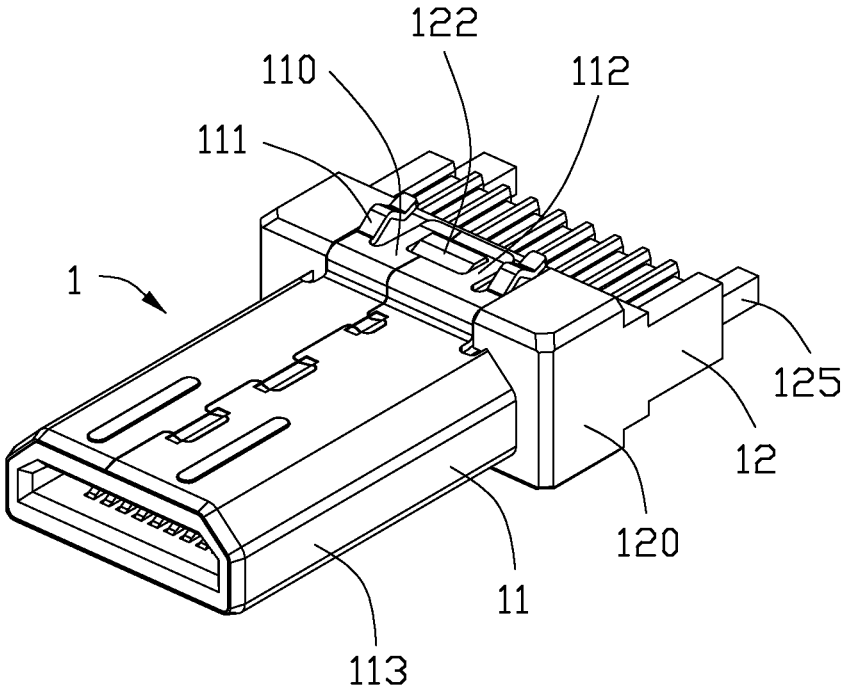
FIG. 5 is another perspective, assembled view of the electrical connector but taken from a different view with respect to FIG. 4.
Figure 6:
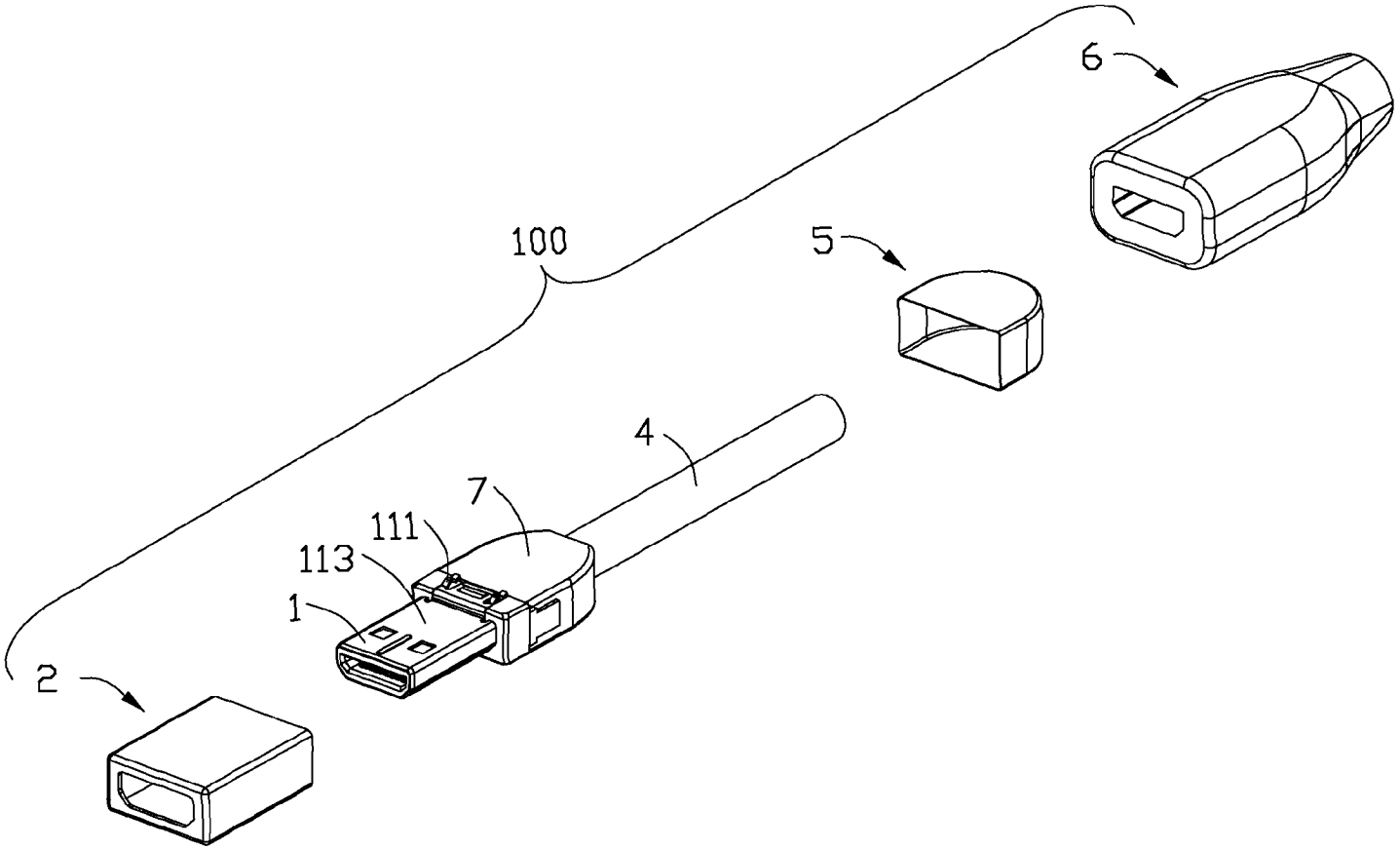
FIG. 6 is a perspective, partially assembled view of the cable connector assembly shown in FIG. 2.
Figure 7:
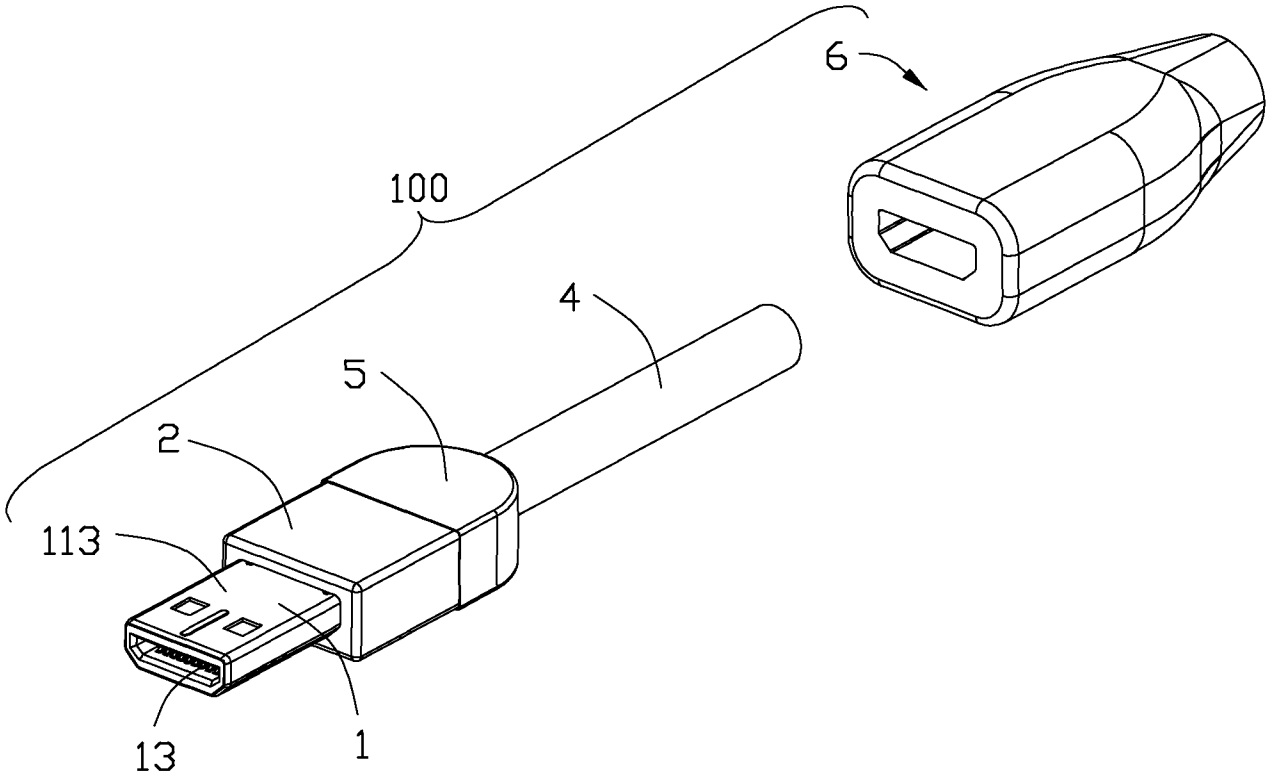
FIG. 7 is a perspective view of the cable connector assembly shown in FIG. 6.

Referring to FIGS. 1 to 7, a cable connector assembly 100 of the present invention comprises an electrical connector 1, a cable 4 electrically connecting with the electrical connector 1, a spacer 3 assembled to the rear end of electrical connector 1 and fixing the cable 4, an inner insulator 7 enclosing a rear end of the electrical connector 1 and a front end of the cable 4, a metallic external shell 2 made via a drawing method and mounted to the electrical connector 1, a copper 5 mounted to the inner insulator 7, and an external cover 6 enclosing the external shell 2 and the copper 5. The electrical connector 100 includes an insulative housing 12, a plurality of terminals 13 received in the insulative housing 12 with corresponding mating sections (not labeled) thereof and a front shell 11 mounted to the insulative housing 12.

The insulative housing 12 includes a base section 120 and a mating section 123 extending forwardly from the base section 120. The insulative housing 12 defines a plurality of terminal receiving passageway 124 receiving the terminals 13. The front shell 11 includes a frame portion 113 enclosing the mating section 123 and a pair of retaining portions 110 extending rearwardly from the frame portion 113 and assembled to the base section 120. The frame portion 113 defines a receiving cavity 114 receiving the mating section 123. The receiving cavity 114 is surrounded by a top wall (not labeled), a lower wall (not labeled) and two side walls (not labeled). The retaining portion 110 comprises a lock portion 112 locked with the base section 120 and a pair of elastic portions 111 bent upwardly from the two sides of the retaining portion 110 for resisting against an inner face of the external shell 2. The base section 120 of the insulative housing 12 defines a locking block 122 corresponding to the locking portion 112 of the front shell 11. The retaining portion 110 respectively extends rearwardly from the top and lower walls of the frame portion 113. The elastic portions 111 extending rearwardly from the frame portion 113 are an elastic structure. The elastic portions 111 are located at the two sides of the locking portion 112. The insulative housing 12 and the spacer 3 are respectively define a positioning post 125 and a positioning hole 35 which are assembled with each other. The external shell 2 forming unitarily a hollow structure, includes a front face (not labeled) with an opening (not labeled) snugly complying with a cross-section of the frame portion and a plurality of side walls (not labeled) extending rearwardly from a periphery of the front face.

In assembly, the terminals 13 are received in the insulative housing 12. The front shell 11 encloses the insulative housing 12. The mating section 123 of the insulative housing 12 is accommodated into the receiving cavity 114 of the front shell 11. The retaining portions 110 of the front shell 11 are assembled to the base section 120 of the insulative housing 12. The locking portion 112 and the locking block 122 are locked with each other. The cable 4 is connected with the terminals 13 electrically and pass through the spacer 3. The spacer 3 is assembled to the rear end of the insulative housing 12. The inner insulator 7 is molded surrounding a rear end of the electrical connector 1 and a front end of the cable 4 by over-molding. The external shell 2 is assembled to the rear of the insulative housing 12 and the front shell 11, and the front of the inner insulator 7 from the front to the rear. The elastic portion 111 of the front shell 11 interferes in the inner face of the external shell 2 for resisting against the inner face of the external shell 2. The copper 5 is assembled to the rear of the external shell 2 and encloses the rear of the inner insulator 7. At last, the external cover 6 encloses the front of the external shell 2, the copper 5 and the cable 4 by over-molding.

In the present invention, the cable connector assembly 100 can transmit high-speed transmission effectively. The front shell 11 has a specific elastic portion 111 used for achieving an interference contact between the front shell 11 and the external shell 2 and improving the function of preventing EMI. Understandably, the elastic portion may be provided by the external shell 2 or other alternatives rather than by the front shell 11.

What is claimed is:

1. A cable connector assembly comprising:

an electrical connector comprising an insulative housing, a plurality of terminals received in the insulative housing, and a metallic front shell mounted to the insulative housing, the insulative housing including a base section and a mating section extending forwardly from the base section, the front shell including a frame portion enclosing the mating section and a retaining portion extending rearwardly from the frame portion and assembled to the base section;

a cable connecting the electrical connector electrically; and a metallic external shell mounted to a rear end of the electrical connector and a front end of the cable;

wherein the retaining portion further comprises a plurality of elastic portions bent outwardly from the retaining portion and resisting against an inner face of the external shell; wherein the external shell is of a hollow structure and including a front face with an opening snugly complying with a cross-sectional dimension of the frame portion, and a plurality of side walls rearwardly extending from a periphery of the front face; wherein the front shell is configured to be adapted to be rearwardly assembled to the housing along a front-to-back direction with the frame portion enclosing the mating portion, and the external shell is configured to be adapted only to be rearwardly assembled to the housing and the front shell along said front-to-back direction with the frame portion extending forwardly through the opening.

2. The cable connector assembly as claimed in claim 1, wherein the retaining portion comprises a locking portion locked with the base section, and the base section defines a locking block corresponding to the locking portion.

3. The cable connector assembly as claimed in claim 2, wherein the elastic portions are located at two sides of the locking portion.

4. The cable connector assembly as claimed in claim 1, wherein the frame portion comprises a top wall, a lower wall, two side walls, and a receiving cavity surrounded by the top wall, the lower wall and the two side walls.

5. The cable connector assembly as claimed in claim 4, wherein the retaining portion extends rearwardly from one of the top wall and the lower wall of the front shell.

6. The cable connector assembly as claimed in claim 1, further comprising an inner insulator enclosing the rear end of the electrical connector and the front end of the cable, and wherein a front end of the inner insulator is enclosed by the external shell.

7. The cable connector assembly as claimed in claim 6, further comprising a cooper mounted to the inner insulator.

8. The cable connector assembly as claimed in claim 7, further comprising an external cover mounted to the external shell and the copper.

9. The cable connector assembly as claimed in claim 1, each of said elastic portions extends in a cantilevered manner with thereof a root rearwardly spaced from the front face of the external shell in the front-to-back direction.

10. A cable connector assembly comprising:

an insulative housing including a base portion and defining a mating portion extending forwardly therefrom;

a plurality of terminals disposed in the housing with contacting sections exposed in the mating portion;

a metallic front shell including a frame portion enclosing the mating portion, and a pair of retaining portions locked to two opposite upper and bottom surfaces of the base portion, respectively; and a metallic external shell being of a hollow structure and including a front face with an opening snugly complying with a cross-sectional dimension of the frame portion, and a plurality of side walls rearwardly extending from a periphery of the front face; wherein the front shell is configured to be adapted to be rearwardly assembled to the housing along a front-to-back direction with the frame portion enclosing the mating portion, and the external shell is configured to be adapted only to be rearwardly assembled to the housing and the front shell along said front-to-back direction with the frame portion extending forwardly through the opening, and one of the front shell and the external shell forms an elastic portion to mechanically and electrically contact the other around the retaining portion after assembled for EMI (Electron-magnetic Interference) prevention consideration.

11. The cable connector assembly as claimed in claim 10, wherein said elastic portion is formed on the front shell.

12. The cable connector assembly as claimed in claim 11, wherein said elastic portion is formed on the retaining portion.

13. The cable connector assembly as claimed in claim 10, wherein said elastic portion extends in an oblique manner in compliance with rearward movement of the external shell in the front-to-back direction.

14. The cable connector assembly as claimed in claim 12, wherein said elastic portion extends in a cantilevered manner with thereof a root rearwardly spaced from the front face of the external shell in the front-to-back direction.

15. A cable connector assembly comprising:

an insulative housing including a base portion and defining a mating portion extending forwardly therefrom;

a plurality of terminals disposed in the housing with contacting sections exposed in the mating portion;

a metallic front shell including a frame portion enclosing the mating portion, and at least a retaining portion locked to the base portion; and a metallic external shell being of a hollow structure and including a front face with an opening snugly complying with a cross-sectional dimension of the frame portion, and a plurality of side walls rearwardly extending from a periphery of the front face; wherein the front shell is configured to be adapted only to be rearwardly assembled to the housing along a front-to-back direction with the frame portion enclosing the mating portion, and the external shell is configured to be adapted only to be rearwardly assembled to the housing and the front shell along said front-to-back direction with the frame portion extending forwardly through the opening, and a metallic elastic portion is mechanically and electrically connected between the front shell and the external shell in a vertical direction perpendicular to said front-to-back direction, around the retaining portion after assembled for EMI (Electron-magnetic Interference) prevention consideration.

16. The cable connector assembly as claimed in claim 15, wherein said elastic portion extends unitarily from the front shell.

17. The cable connector assembly as claimed in claim 16, wherein the front shell is formed via forming from sheet metal so as to form the retaining portion extending rearwardly from a rear edge of the frame portion while the external shell is formed via drawing with even rear edges of said plurality of side walls.

18. The cable connector assembly as claimed in claim 15, wherein said elastic portion is located around the retaining portion.

19. The cable connector assembly as claimed in claim 18, wherein said elastic portion extends in a cantilevered manner with thereof a root rearwardly spaced from the front face of the front shell in said front-to-back direction.

20. The cable connector assembly as claimed in claim 15, wherein said elastic portion is configured to extend in an oblique direction in compliance with rearward movement of the external shell during assembling.

* * * * *